US007581506B2

(12) United States Patent
Whitney

(10) Patent No.: US 7,581,506 B2
(45) Date of Patent: Sep. 1, 2009

(54) CARGO TRANSPORT DEVICE FOR TOWING BEHIND WATERCRAFT

(76) Inventor: Shawn Whitney, Box 294, Terrace Bay, ON (CA) P0T 2W0

( * ) Notice: Subject to any disclaimer, the term of this patent is extended or adjusted under 35 U.S.C. 154(b) by 0 days.

(21) Appl. No.: 12/112,131

(22) Filed: Apr. 30, 2008

(65) Prior Publication Data

US 2008/0216733 A1 Sep. 11, 2008

Related U.S. Application Data

(63) Continuation-in-part of application No. 11/620,771, filed on Jan. 8, 2007, now abandoned.

(60) Provisional application No. 60/759,069, filed on Jan. 17, 2006.

(51) Int. Cl.
*B63B 21/58* (2006.01)

(52) U.S. Cl. ..... 114/249

(58) Field of Classification Search ..... 114/250, 114/218, 247, 242, 249, 344, 347
See application file for complete search history.

(56) References Cited

U.S. PATENT DOCUMENTS 2,370,926 A * 3/1945 Warner ..... 280/493
5,119,752 A 6/1992 Doherty
5,188,054 A 2/1993 Jacobs, Jr.
5,357,891 A 10/1994 Kobayashi et al.
5,435,261 A * 7/1995 Androus ..... 114/256
5,524,914 A * 6/1996 Doherty et al. ..... 280/24
5,765,851 A 6/1998 Parent
5,791,280 A 8/1998 Egan et al.
5,878,684 A 3/1999 Adams
6,112,692 A 9/2000 Lekhtman
6,189,900 B1 2/2001 MacDonald
6,401,648 B1 6/2002 Abbenhouse
2003/0233971 A1 12/2003 Belyeu
2004/0211350 A1 10/2004 Carter

* cited by examiner

*Primary Examiner*—Ed Swinehart
(74) *Attorney, Agent, or Firm*—Adet Company Inc.; Ryan W. Dupuis; Kyle R. Scatterthwaite

(57) ABSTRACT

A hitching device permits towing a cargo transport device behind a kayak. The cargo transport device comprises a watertight container and a connection member extending along a longitudinal axis between the container and the watercraft. The connection member includes a swivel such that the container and watercraft on opposite sides of the swivel are freely rotatable about the longitudinal axis relative to one another. This free pivoting allows relative rotation between the container and watercraft such that each can react to outside forces, for example those exerted by waves, independently. As a result, rolling of the container does not tend to induce rolling of the watercraft and so the ride quality of the watercraft is not significantly reduced by the hitching device.

20 Claims, 7 Drawing Sheets

CARGO TRANSPORT DEVICE FOR TOWING BEHIND WATERCRAFT

This application is a continuation in part of U.S. parent application Ser. No. 11/620,771, filed Jan. 8, 2007 which also claims the benefit under 35 U.S.C. 119(e) of U.S. provisional application Ser. No. 60/759,069, filed Jan. 17, 2006.

FIELD OF THE INVENTION

This invention relates to a towing device for towing a cargo vessel behind a kayak, and more particularly relates to a watertight cargo vessel that can be towed behind a kayak for relative rolling movement therebetween so as to cause minimum detrimental effect on the ride quality of the kayak.

BACKGROUND OF THE INVENTION

People using watercraft for travel or recreation often find that storage space for cargo such as camping equipment, clothes, food and other supplies is quite limited. This is particularly true in the case of smaller watercraft, for example a canoe or kayak. One known solution to this problem is to pack articles inside a watertight bag, often referred to as a dry bag, and then tie the bag to the watercraft with a rope or other suitable line. The bag can then be dragged behind the craft within the water while keeping its contents dry. These bags are generally limited to carrying relatively small items, increase the resistance to motion of the craft through the water and tend to develop leaks over time.

U.S. Pat. No. 5,791,280 describes a towable cargo device having a boat-like shape for towing behind a watercraft. The device is connected to the watercraft by means of conventional tow lines. During forward acceleration, these tow lines become taught due to the weight of the device being pulled. However, a loss in forward acceleration may cause the ropes to become slack. This may cause the device to collide with the rear of the watercraft or create a jerking effect thereon when the watercraft accelerates forward and removes the slack from the toe lines. With the lines are slack, the watercraft is only pulling the relatively insignificant mass of the lines forward. Once the lines are stretched taught between the craft and the towable device, the mass of device is added to the load being propelled forward. This sudden increase in mass causes a sudden reduction in the acceleration rate of the watercraft achieved by its driving force, causing the jerk or kickback effect.

U.S. Pat. No. 5,119,752 describes a towable cargo device having a tongue formed by two metal bars for towing behind a watercraft. At a forward end of the tongue, there is provided a hook for attachment to the towing means of the watercraft, which are not detailed in the patent. Where the towing means is a rope or similar flexible connection, it should be appreciated that the aforementioned jerk or kickback may also be experienced when using this particular invention. Alternatively, it may be possible to connect the hook directly to the watercraft to provide a rigid connection which eliminates the jerking effect by maintaining a fixed distance between the watercraft and cargo device. However, this would not allow any relative movement between the watercraft and cargo device, thereby eliminating independent reaction to irregularities in the water surface and therefore reducing ride comfort.

As a result, there is a desire for a cargo carrying device that can be towed behind a watercraft without creating excessive drag or substantially reducing ride quality and corresponding rider comfort.

SUMMARY OF THE INVENTION

According to one aspect of the present invention there is provided a hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak;

the connection member comprising a swivel disposed between the first and second ends of the connection member;

the swivel being arranged to allow relative rolling motion between the first and second ends of the connection member about an axis extending in the longitudinal direction of the connection member such that the container is arranged to be rotatably connected to the kayak about the longitudinal axis.

The relative pivotal motion allowed about the longitudinal axis by the swivel in the connection member helps maintain independence between the reaction of the watercraft and the container being towed thereby to outside forces. For example the container is allowed to undergo rolling due to crashing of waves against its sides without tending to induce similar rolling of the watercraft. This would prove useful in situations where the watercraft and container are not aligned parallel with oncoming waves, as a single wave would impact the watercraft and the container at different times.

The device may be provided in combination with a cargo transport device comprising a watertight towable container having a hollow interior arranged to receive cargo, at least one opening arranged for access to the interior, and a lid arranged to close said at least one opening in a transport position such that the hollow interior is arranged to be fully enclosed in the transport position.

The device may also be provided in combination with a kayak wherein the container has a streamlined shape narrowing in a horizontal plane towards opposite ends of the container such that the cargo transport device and the kayak are substantially similar shape and the container is less than or equal to the kayak in width measured transverse to the longitudinal direction in a horizontal plane.

There may be a plurality of openings in a top side of the container such that the openings span a majority of the top side of the container and wherein there is provided a lid arranged to selectively close each opening.

When there is provided two openings in a top side of the container, each opening preferably extends from an inner end adjacent a centre of the container to an outer end adjacent a respective end of the container with each opening including a lid arranged to selectively close the opening in which the lid is hinged on the container adjacent the outer end of the respective opening.

When the container is supported on a pair of wheels adjacent one end of the container for rolling movement along the ground, each of the wheels is preferably received within a respective recessed wall portion in a bottom side of the container.

When the connection member is arranged for connection to the container adjacent a first end of the container, the hitching device may further comprise a second connection member attached to the container adjacent a second end opposite the first end and arranged for connection to a second watertight towable container.

The connection member is preferably arranged to be fixed in length between the first end and the second end of the connection member.

There may be provided a pivot assembly at the first end of the connection member arranged for connection to the cargo transport device for relative pivotal movement about a first horizontal axis oriented transversely to the longitudinal direction and another pivot assembly at the second end of the connection member arranged for connection to the cargo transport device for relative pivotal movement about a second horizontal axis oriented transversely to the longitudinal direction.

There may be provided a fixed connecting portion arranged for fixed mounting on the kayak and a detachable connecting portion on the second end of the connection member arranged for selective detachment from and reattachment to the fixed connecting portion.

The swivel preferably comprises a ball secured to one of the ends of the connection member and a socket connector secured to the other one of the ends of the connection member in which the socket is arranged to receive the ball in mating connection therein such that the first and second ends of the connection member are fully rotatable relative to one another about the axis extending in the longitudinal direction.

The socket may comprise first and second portions arranged to be separable from one another along a plane extending in the longitudinal direction to release the ball therefrom. Preferably a clamping member is arranged to selectively secure the first and second portions to one another with the ball received therebetween such that the ball is arranged to be selectively retained in the socket.

The clamping member may comprise a collar which is slidable in the longitudinal direction between a clamping position in which the collar is clamped about the first and second portions to retain the ball in the socket and a released position in which the first and second portions are separable from one another to release the ball from the socket.

The collar is preferably biased towards the clamped position.

There may be provided a pair of hitch arms spaced apart from one another and extending generally in the longitudinal direction from the second end of the connection member so as to be arranged for connection at spaced apart positions on the kayak. The swivel is preferably located between the hitch arms and the first end of the connection member for relative rolling movement of the hitch arms relative to the first end of the connection member about the longitudinal axis.

The hitch arms may be adjustable in length such that the swivel is arranged to be adjustable in the longitudinal direction relative to the kayak.

According to a second aspect of the present invention there is provided a hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak;

the connection member comprising a connector disposed between the first and second ends of the connection member;

the connector being movable between a first position in which the first and second ends of the connection member are coupled to one another at a fixed spacing in the longitudinal direction such that the kayak and the cargo transport device are arranged to be supported at a substantially fixed spacing relative to one another and a second position in which the first and second ends are coupled to one another by a flexible tether such that the kayak and the cargo transport device are arranged to be freely displaced relative to one another.

According to a third aspect of the present invention there is provided a hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak;

the connection member comprising a connector disposed between the first and second ends of the connection member;

the connector being movable between a first position in which the first and second ends of the connection member are coupled to one another at a fixed spacing in the longitudinal direction such that the kayak and the cargo transport device are arranged to be supported at a substantially fixed spacing relative to one another and a second position in which the first and second ends are arranged to be freely displaced relative to one another; and the connection member further comprising an actuator arranged to control displacement of the connector between the first and second positions, the actuator being arranged for connection between the connector and an operator seat of the kayak such that the connector is arranged to be displaced between the first and second positions by an operator in the operator seat of the kayak.

According to another aspect of the present invention there is provided a cargo transport device for towing behind a watercraft, said device comprising:

a watertight towable container; and a connection member extending generally in a direction of a longitudinal axis from a first connection point for connection to the container to a second connection point for connection to the watercraft;

the connection member comprising a swivel disposed between the first and second connections points and arranged to allow relative pivotal motion between portions of said connection member on opposite sides of said swivel about the longitudinal axis.

According to a further aspect of the present invention there is provided a cargo transport device for towing behind a watercraft, said device comprising:

a watertight towable container; and a connection member extending in a longitudinal direction from a first connection point arranged for connection to the container to a second connection point arranged for connection to the watercraft;

a distance between the first and second connection points being substantially fixed.

According to yet a further aspect of the present invention there is provided a cargo transport device for towing behind a watercraft, said device comprising:

a watertight towable container; and a connection member extending in a longitudinal direction from a first connection point arranged for connection to the container to a second connection point arranged for connection to the watercraft;

the container having a streamlined shape narrowing toward opposite ends thereof in the longitudinal direction.

The streamlined shape of the container reduces the resistance to forward motion experienced by the container as it is pulled through the water by the watercraft, thereby increasing towing efficiency. In other words, the amount of drag exerted on the container during towing is kept relatively low. Maintaining a constant distance between the connection points reduces the occurrence of jerking or kickback on the watercraft as the container will tend to move with it.

Preferably the streamlined shape narrows in a horizontal plane toward the opposite ends of the container.

Preferably the connection member is pivotable about a pivot axis extending transverse to the longitudinal axis at one or both of the first and second connection points to allow relative vertical movement therebetween. This further allows the watercraft and container to react to outside forces independently and thus increase ride comfort.

Preferably there is provided wheels supported on the container for rolling motion thereof along a ground surface.

Preferably the wheels are disposed proximate one end of the container such that lifting of an opposite end engages the wheels with the ground surface. Rolling motion allows easy transport of the device over a relatively flat surface by eliminating the need to lift and carry the entire container.

Preferably the connection member comprises a fixed portion at the second connection point for fixed mounting on the watercraft.

Preferably the fixed portion of the connection member is riveted for attachment to the watercraft. It is also preferable that the fixed portion of the connection member is also epoxied for waterproof attachment to the watercraft.

Preferably the connection member further comprises a detachable portion removably connected to the fixed portion for selectively disconnecting the watercraft and container.

Preferably the connection member is adapted at the first connection point to be selectively detachable from the container.

The connection member may be connected to the container adjacent a first end thereof and the device may further comprise a second connection member attached to the container adjacent a second end opposite the first end for connection to a second watertight towable container.

Preferably the watertight container is closable to define an enclosed space therein.

The device may be provided in combination with a kayak extending in the longitudinal direction, wherein the container of the device is less than or equal to the kayak in width measured transverse to the longitudinal axis in a horizontal plane.

The kayak and container may be of substantially similar shape in at least the horizontal plane.

In one embodiment, the first and second connection points of the connection member are joined by an elastic member such that the first and second connection points are spaced by a first prescribed distance when the elastic member is in a relaxed state and such that the first and second connection points are spaced by a second prescribed distance greater than the first prescribed distance and are biased towards the first prescribed distance when the elastic is in a stretched state.

In an alternative embodiment, a distance between the first and second connection points is substantially fixed.

BRIEF DESCRIPTION OF THE DRAWINGS

In the accompanying drawings, which illustrate an exemplary embodiment of the present invention.

In the drawings like characters of reference indicate corresponding parts in the different figures.

DETAILED DESCRIPTION

Figure 1:
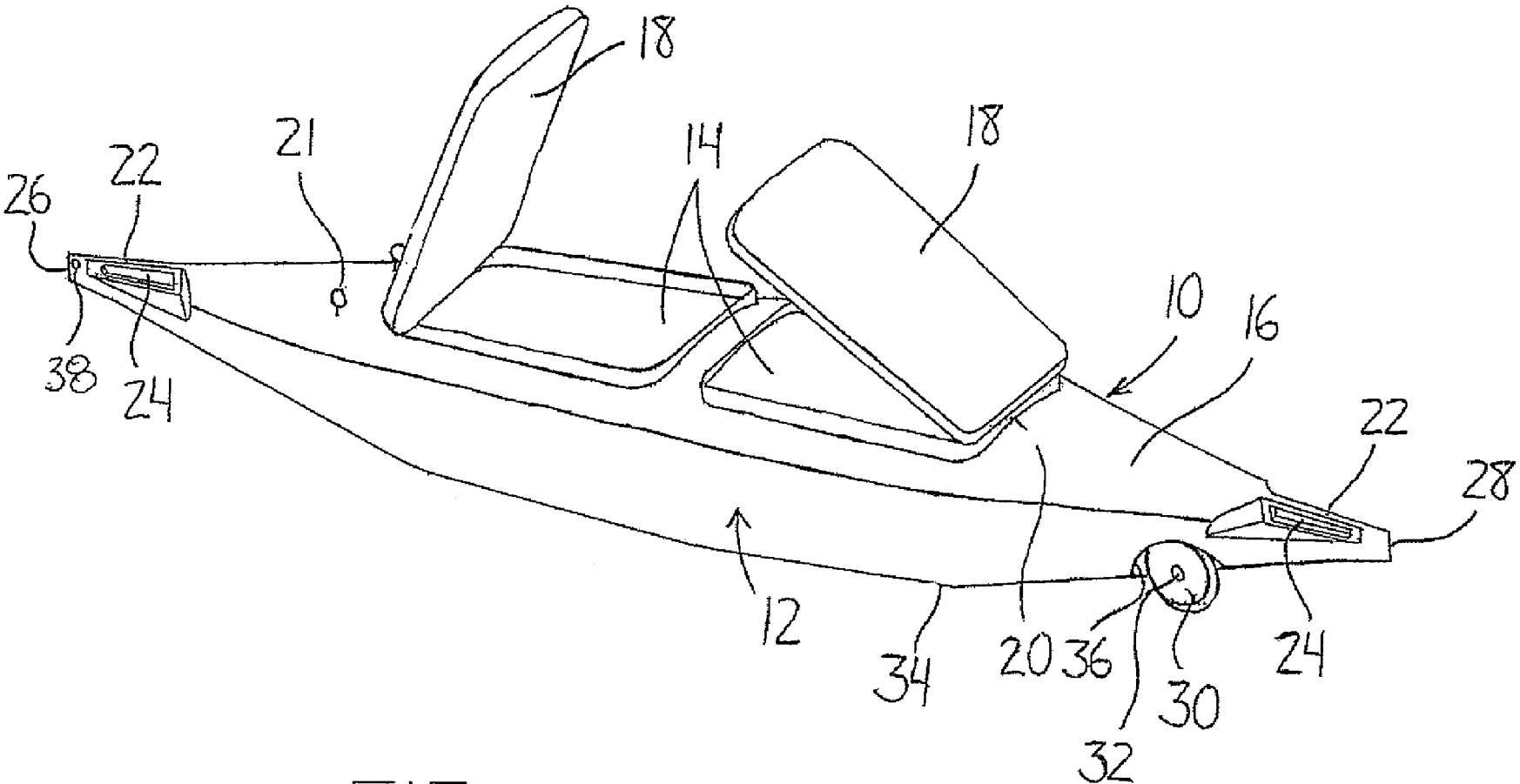
FIG. 1 is an isometric view of the watertight towable container of the cargo transport device according to the present invention.
Figure 2:
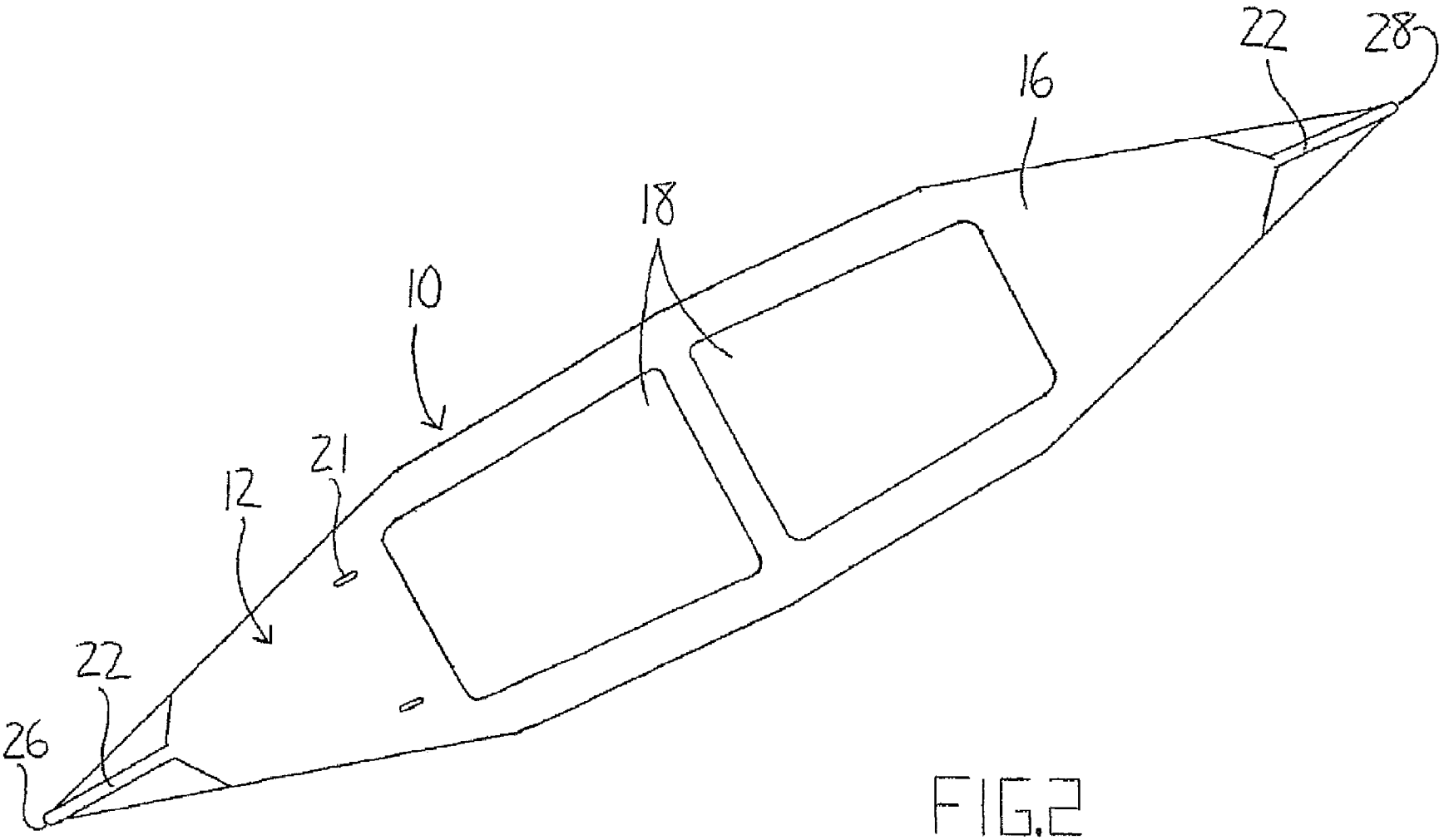
FIG. 2 is an overhead plan view of the container of FIG. 1.

As shown in FIG. 1, the container 10 of the cargo transport device features a body 12 having the general shape of a kayak, that is narrowing toward its opposite ends in both horizontal and vertical planes to reduce resistance to motion through water. The container 10 is hollow inside to allow the storage of various cargo within. Access to the container's interior is provided by openings 14 in the top surface 16 which are closable by means of lids 18. Each lid 18 is pivotally supported along an edge 20 of its respective opening 16 nearest a respective end of the container 10. With the lids mounted in this fashion and at least partially opened, as shown in FIG. 1, the interior of the container 10 can be accessed from either side. The body 12 is constructed to be water tight to prevent leaks and retain buoyancy when placed on the surface of a body of water. The lids 18 are closable in a sealing manner such that the container 10 as a whole is rendered watertight with the lids in the closed position, as shown in FIG. 2. This ensures that the contents of the container 10 remain dry regardless of the container's exposure to water from any direction. The container 10 may include fastening loops 21 supported on the top surface 16 for the attachment of tie-down straps or cords for stowing cargo that is not water sensitive on top of the body 12.

An integral handle 22 at each of the front and rear ends 26, 28 is defined by a transverse hole 24 through the body 12 to provide a convenient gripping surface for lifting of the container. A pair of wheels 30, each individual wheel disposed on an opposite side of the container 10, is supported near the rear end 28 for rotation about a common axle 32. Due to the upward slope of a bottom surface 34 of the body 12 toward each end, the wheels 30 are supported so as to be spaced upward from a flat ground surface with the container 10 resting thereon. Lifting the front end 26 by the handle 22 thereat pivots the container body 12 about a transverse axis thereof causing the wheels 30 to move downward and engage the ground surface. Still using the handle 22, the container 10 can then be pulled along the ground surface for travel over land, eliminating the need to lift the entire container where ground conditions are suitable for rolling motion. The bottom surface 34 of the body features a recess 36 extending transversely inward on either side of the longitudinal axis of the container 10 near the rear end 28 thereof. The wheels 30 are supported in these recesses 36 so as to not extend outward from the body 12 in the transverse direction. The wheels 30 and axle 32 may be mounted in a removable manner so that they may be attached and detached for transport of the container on land and in water respectively.

As seen in FIG. 1, a hole 38 is provided through the body 12 adjacent the front end 26 in order to facilitate connection of the container 10 to a watercraft for towing thereby.

Figure 3:
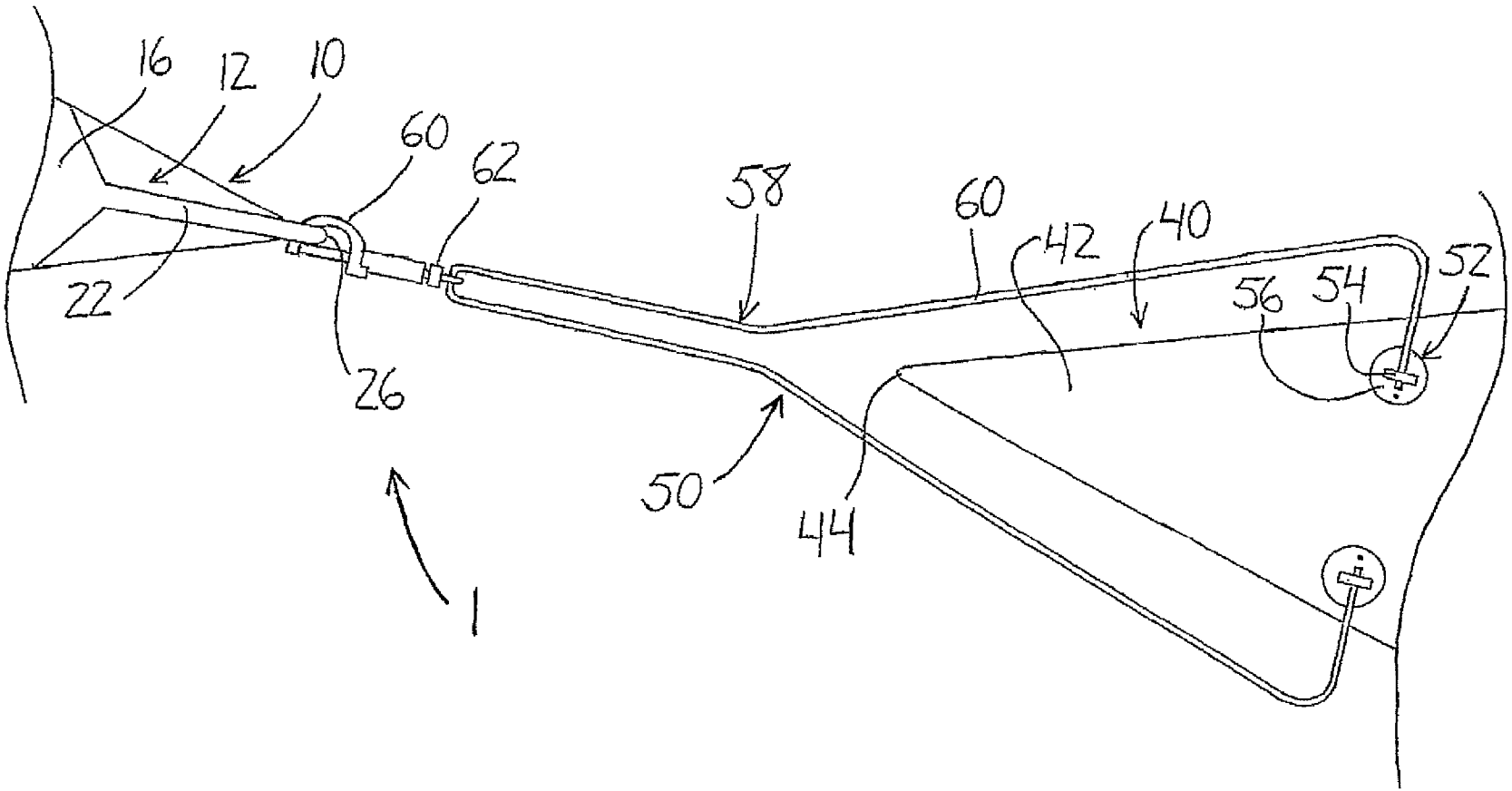
FIG. 3 is an overhead plan view of the connection member of the cargo transport device connecting the container to a kayak.
Figure 4:
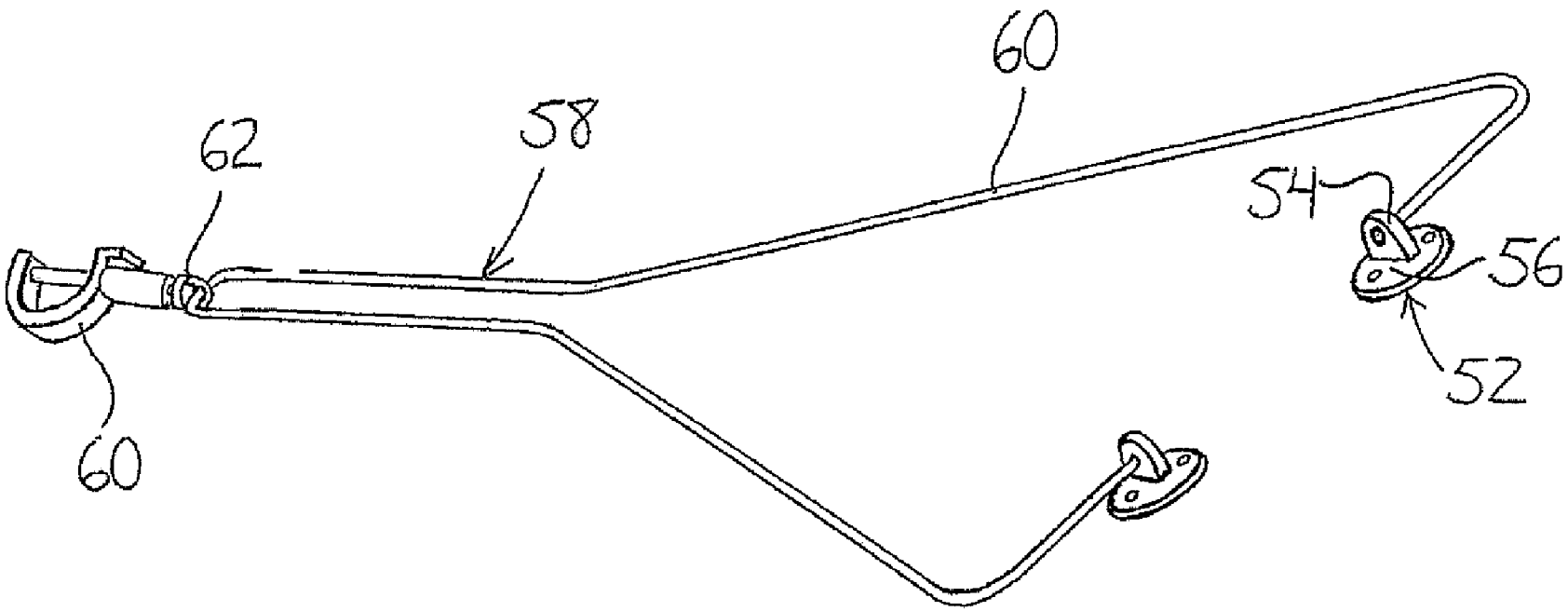
FIG. 4 is an isometric view of the connection member of FIG. 4.

FIG. 3 shows the container 10 connected to a kayak 40 by a first embodiment of a connection member 50. The connection member 50 according to the first embodiment features fixed mounting elements 52 for attachment to kayak. Each mounting element features a lug 54 extending upward from a mounting pad 56 that is attached to an upper surface 42 near the stern 44 of the kayak 40. The pad 56 is attached to the kayak 40 by rivets or other suitable fasteners and then further secured with epoxy in order to provide a waterproof seal between the kayak 40 and mounting element 52. The lug 54 of each mounting element 52 features a hole through which a respective end of bent rod 58 is passed. The rod 58 is bent to define two legs 60 that diverge moving from the container 10 to the kayak 40 so as to extend along opposite sides thereof and then bend towards each other such that their ends pass through the lugs 54 of the mounting elements 52. Opposite the leg ends, the rod 58 is connected to a self-locking hook 60 by a swivel 62. The hook 60 is allowed to lock after being passed through the hole 40 near the front end of the container 10 to removably secure the connection member 50 thereon. The swivel 62 permits relative rotation between the hook 60 and the bent rod 58 about a longitudinal axis along which the connection member 50 extends. This allows relative rotation between the container 10 and kayak about the same axis such that each can react independently to forces exerted thereon during water travel. The rod 58 is free to pivot about a pivot axis extending through the lugs 54 transverse to the longitudinal axis. It should be appreciated that the connection member 50 can also pivot about an axis defined by the hole 38 in the container body 12, as the hook 60 and hole 38 do not provide a rigid connection. This pivotal arrangement allows relative vertical movement to occur between the kayak 40 and container 10. These degrees of freedom help ensure that the kayak 40 and container 10 can react to outside forces independently such that the towing of the container has not significantly affect the ride quality of the watercraft. Furthermore, the substantial rigidity of the rod 58 in the longitudinal direction prevents the creation of slack between the container 10 and kayak 40 so as to avoid the jerking effect experienced with a flexible connection, such as a rope.

The ends of the rod 58 can be pulled back through the lugs 54 of the mounting elements 52 so as to disconnect the rod 58, swivel 62, hook 60 and container 10 from the kayak 40. The mounting elements 52 do not interfere with regular use of the kayak 40, but allow fast and easy connection of the towable container 10 when needed. Disconnecting the entire connection member 50 from the container 10 by removing the hook 60 from the hole 38 and then disconnecting the rod 58 from the mounting elements 52 allows the majority of the connection member components to be stored away, for example within the container 10, when the device 1 is not being towed. In other words, a detachable portion of the connection member 50 defined by the rod 58, swivel 62 and hook 60 improves the portability and storability of the device 1 by allowing selective reduction of its overall size, while a fixed portion of the connection member 50 defined by the mounting elements 52 improves the ease of use of the device 1 without detrimentally affecting the appearance or use of the kayak 40 alone.

The legs 60 of the rod 58 diverge to opposite sides of the kayak 40 as shown in FIG. 3 before connecting to the mounting elements 52 so as to allow use of the present invention with a kayak having a stern mounted rudder without interfering with the mounting and operation of thereof. It should be appreciated that the rod 58 may be replaced with an alternate member that extends between the container 10 and kayak 40 on only one side of a central longitudinal axis of the kayak so as to go around an area left open for the mounting of a rudder on the stern. Obviously, in such a case, there would not be a need for two separate mounting elements on the kayak.

Shaping the container 10 similar to the kayak 40 provides the towable device 1 with similar handling characteristics to that of the watercraft towing it. It should be appreciated, however, that the present invention may be used with watercraft other than kayaks. Keeping the width of the container 10, perpendicular to the longitudinal direction, equal or less than that of the watercraft helps keep the towable device 1 inside the wake of the watercraft so as to minimize the disruption of smooth motion through the water. The container 10 may be equipped with one or more keels or ribs on the bottom surface 34 in order to encourage travel in a straight line. Different types of keels, including those adapted for removable mounting, are known to those of skill in the art of watercraft and may be applied to the present invention, so long as the container is built watertight to keep the interior dry.

A second pair of mounting elements 52 may be provided near the rear end 28 of the container 10 such that a second container may be towed behind it by means of a second a second connection member.

By reducing resistance to motion through water, the streamlined kayak-like shape of the container increases the efficiency of towing. This allows more cargo to be towed with less energy input required. For example, use of the device with a paddled watercraft allows a paddler to transport a greater amount of cargo or reduce the strain experienced in transporting a particular amount of cargo. The device can be easily transported on a conventional kayak or canoe carrier supported atop an automobile.

Figure 5:
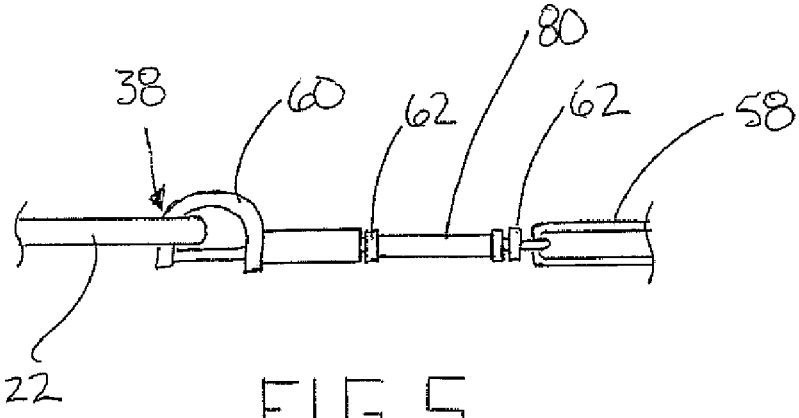
FIG. 5 is a plan view of an alternative embodiment of the connection member connecting the container to a kayak.
Figure 6:
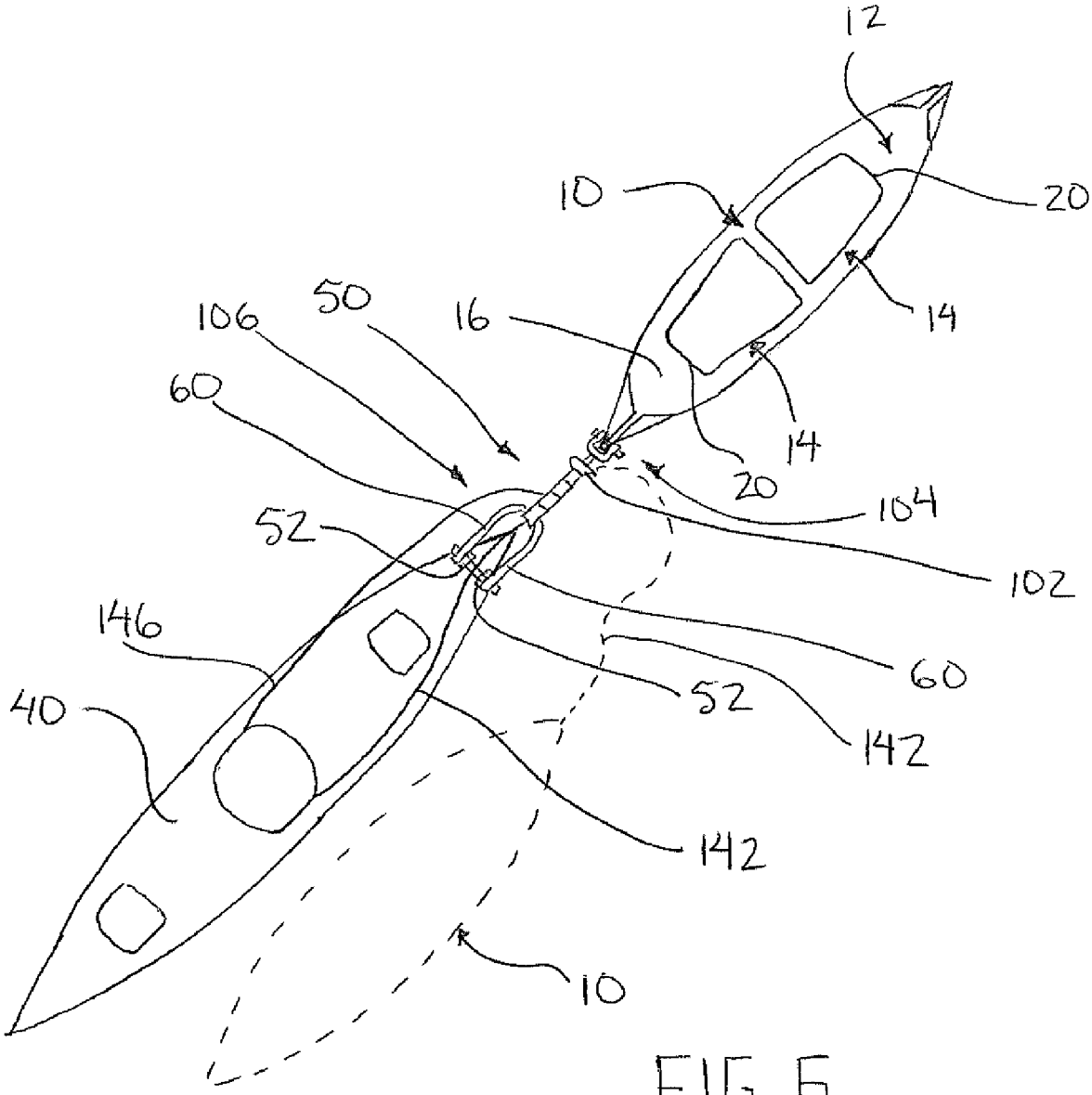
FIG. 6 is a schematic plan view of a further embodiment of the connection member connecting the container to the kayaks.
Figure 7:
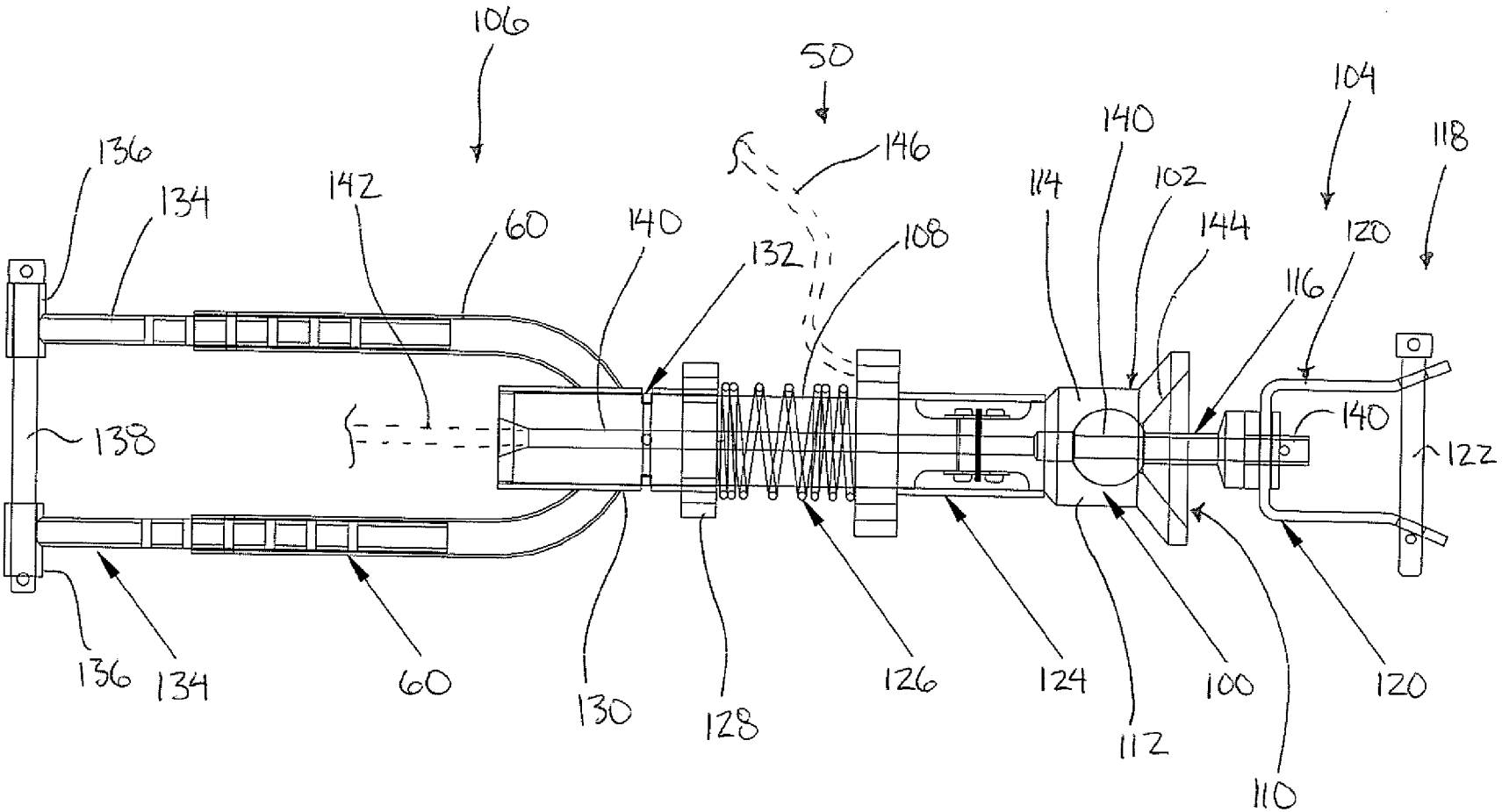
FIG. 7 is a plan view of the connection member according to FIG. 6 shown in greater detail.
Figure 8:
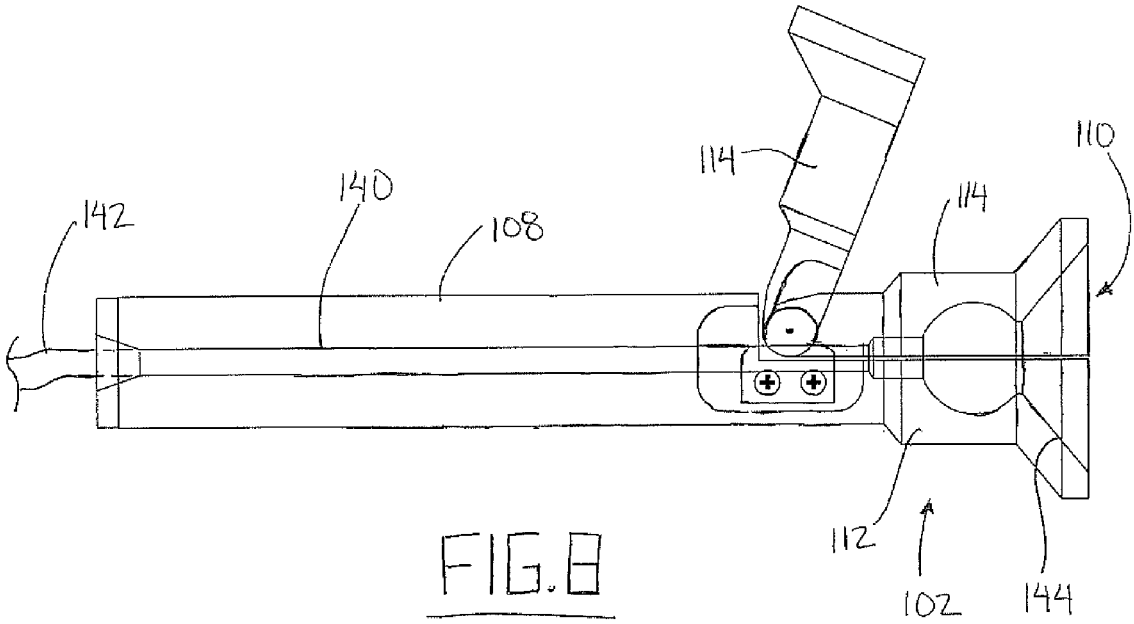
FIG. 8 is a side elevational view of the socket according to the connection member of FIG. 6 shown in a released position.
Figure 9:
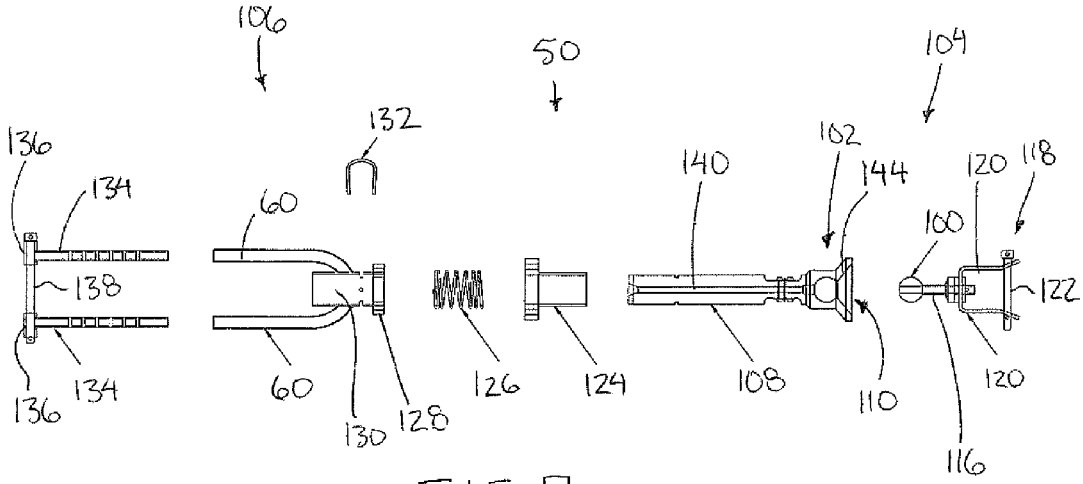
FIG. 9 is an exploded plan view of the various components of the connection member according to the embodiment of FIG. 6.

Turning now to FIG. 5, a further embodiment of the attachment between the connection member 50 and the front end 26 of the container body is shown. In this instance, the self locking hook (or latch) 60 is similarly used for cooperation with the hole 38 in the container body. The hook 60 is attached to the rod 58 of the connection member 50 by two swivels 62 connected by an elastic member 80 connected in series therebetween. Accordingly a first one of the swivels 62 is coupled in series between the hook 60 and the elastic member 80 while the second one of the swivels 62 is coupled in series between the other end of the elastic member 80 and the rod 58 of the connection member. In this arrangement, the first and second connection points of the connection member for connection to the container body and the kayak respectively are joined by an elastic member such that the first and second connection points are supported at a movable distance relative to one another as the elastic stretches. The first and second connection points are spaced by a first prescribed distance when the elastic member is in a relaxed state and are spaced by a second prescribed distance greater than the first prescribed distance in a stretched state. In the stretched state, the elastic nature of the member 80 biases the connection points back from the second prescribed spacing to the first prescribed spacing. The elastic member 80 is useful for maintaining a taught connection between the towable container and the kayak.

As described above, by providing a container in which all of the openings are arranged to be fully closed by respective lids, the hollow interior is arranged to be fully enclosed so that the hollow interior is wholly weatherproofed and protected from entry of water therein. In a preferred embodiment as noted above, two openings are provided in the top side of the container which span a majority of the top surface of the container for maximizing access to the hollow interior. Each opening spans from an inner edge or inner end adjacent a longitudinal center of the kayak to an outer edge 20 at the opposed outer ends of the kayak. The lids are hinged at the outer edges 20 respectively so that both openings open towards the center of the kayak as the lids are opened to further maximize access to the hollow interior of the container for storage.

As further noted above, the pair of wheels which support the kayak for rotation along the ground are located within respective recessed wall portions 36 such that a majority of the volume of each wheel is recessed in relation to surrounding walls of the kayak to minimize drag in the water if the wheels are left mounted on the kayak. The recessed wall portion 36 which receives each wheel therein is continuous and sealed with respect to the surrounding wall of the kayak to further ensure that the hollow interior is fully waterproof and water is prevented from entering.

In the preferred arrangements of the connection member 50, the connection member is rigid and fixed in length between the swivel and each end of the connection member forming the hitching device which are arranged for mounting on the container and the kayak respectively so that the length between the kayak and the container as defined by the hitching device remains substantially fixed. The pivot assembly is provided at both ends of the connection member forming the hitching device to ensure that both ends of the connection member are pivoted relative to the container and the kayak respectively about respective horizontal axis oriented perpendicular to the longitudinal direction of the connection member.

At each end of the connection member there is provided a fixed portion of the hitching device which is arranged to be fixed onto the kayak while a cooperating detaching portion is provided on the connection member or coupled thereto is arranged to be selectively mounted onto the corresponding fixed portion in mating connection therewith for ready attachment and subsequent detachment as may be desired. On the kayak the fixed portions comprise fixed mounting elements 52 secured by various means as noted above.

In each embodiment the two legs 60 of the connection member define a pair of hitch arms which are spaced apart from one another in a horizontal and lateral direction perpendicular to the longitudinal direction with each arm extending generally in the longitudinal direction from the second end of the connection member towards the kayak for mounting at a pair of spaced apart positions on the kayak. The hitch arms 60 are suitably arranged for receiving the stern of the kayak therebetween.

Turning now more particularly to the embodiment of the connection member shown in FIGS. 6 through 9, the swivel 62 in this instance comprises a ball 100 arranged to be received within a respective socket 102. The ball and socket are provided in the connection member at a location between a first end 104 arranged to be secured to the container and the second end 106 thereof arranged to be secured to the kayak. More particularly, the ball 100 is arranged to be fixed relative to the first end 104 of the connection member comprising the rear end which arranged for securement to the cargo transport device while the socket 102 is arranged to be fixed relative to the first end 104 of the connection member which comprises the front end arranged to be secured to the kayak. In this arrangement the first and second ends of the connection member are rotatable relative to one another such that the kayak and the container are similarly rotatable relative to one another for full rotations about a longitudinal axis extending in the longitudinal direction of the connection member.

According to the second embodiment of the connection member 50, the member generally comprises a central shaft 108 which extends in the longitudinal direction. The socket is supported at the rear end of the shaft to receive the ball through an open side 110 of the socket which faces rearwardly towards the container. The socket comprises a lower first portion 112 and an upper second portion 114. The first and second portions 112 and 114 divide the socket along a horizontal plane extending in the longitudinal direction so that the socket is longitudinally divided in two halves. When the two halves are separated the ball can be entered and removed from the socket, however when the two halves are brought together the socket surrounds more than half of the ball so that an annular mouth is provided on the socket which is smaller in diameter than the diameter of the ball to retain the ball in the socket when closed while still permitting the ball to be rotatable therein.

The lower first portion of the socket is arranged to be fixed relative to the shaft, while the upper portion 114 is pivotal at a forward end relative to the shaft for pivotal movement about a horizontal axis so that the open side facing rearwardly can be opened up and enlarged in dimension sufficiently to allow the ball to enter into the socket. When the upper second portion is pivoted back downwardly against the lower portion, the socket is again closed about the ball to retain the ball therein.

When closed, the ball is fully rotatable about the longitudinal axis while also being able to be pivoted in any direction away from the longitudinal axis so that the first end 104 of the connection member arranged to be connected to the cargo transport device permits the cargo transport device to be pivoted up and down or in a side to side motion relative to the central shaft in additional to relative rolling movement therebetween about the longitudinal axis.

The ball is secured to the container by a stem 116 which extends rearwardly from the ball to a pivot assembly 118 arranged to secure the ball to the container for relative pivotal movement about a horizontal axis oriented perpendicularly to the longitudinal direction. The pivot assembly generally comprises two spaced apart flanges which are parallel and horizontally spaced apart such that a suitable axle pin 122 is arranged to be received through the free ends of the two flanges 120 opposite the stem 116 of the ball. The axle 122 is received through a suitable cooperating aperture in the end of the cargo transport device. The axle pin 122 is retained by suitable retainer pins which allow quick releasing of the connection member from the container as may be desired.

To retain the ball in the socket with the socket in a closed position, a suitable clamp 124 is provided in the form of a slide collar which is supported for sliding movement along the shaft in the direction of the longitudinal axis. The collar is slidable between an open position in which the two portions of the socket are unobstructed so that the upper portion is free pivotal upwardly relative to the lower portion to readily release the ball therefrom, and closed position in which the two portions of the socket are at least partially surrounded by the collar so that the collar serves to clamp the two portions together in a mated position which the ball matingly received therein and retained therein.

In the open position the collar is positioned forwardly of the socket along the shaft 108 so that biasing the collar rearwardly towards the socket biases the collar into the closed position. A suitable spring 126 is provided in connection between an annular flange at the forward end of the collar forming the clamp 124 and a suitable flange 128 which is generally annular about the shaft and projects radially outward therefrom adjacent a forward end of the shaft. The flange 128 is supported on one end of a mounting collar 130 which slidably receives the forward end of the shaft 108 therein. The spring 126 is mounted about the shaft to be compressed in the axial direction thereof between the flange 128 of the mounting collar 130 fixed at the forward end of the shaft and the annular flange of the slide collar slidable between a central open position and a closed position adjacent the rear of the shaft at the socket.

The mounting collar slidably receives the shaft therein and retains the shaft by a locking pin 132 received through cooperating apertures therein. Two hitch arms 60 are provided fixed on the mounting collar to extend generally forwardly in the longitudinal direction at laterally spaced apart positions generally parallel with one another to extend from the second end of the connection member towards the kayak.

Each hitch arm comprises a hollow tube arranged to slidably receive a post 134 therein for relative sliding movement in the longitudinal direction to adjust an overall length of the hitch arms 60.

The forward or outer ends of each post 134 supports a pivot tube 136 fixed therein which is oriented perpendicularly to the post and the hitch arm 60. The two pivot tubes 136 of the hitch arms are arranged to be aligned with one another by receiving a horizontal shaft 138 extending therethrough to define a horizontal pivot of the connection member relative to the kayak. Cooperating apertures in the posts 134 and the hitch arm 60 receiving the post therein permit suitable locking pins to select the appropriate length at which the hitch arms are locked in a mounted position. Accordingly the swivel of the connection member is arranged to be adjustable in spacing relative to the kayak.

The spaced apart hitch arms 60 permit two laterally spaced apart connection points to be provided on the kayak in the form of mounting elements 52 fixed on the kayak which also receive the shaft 138 therethrough. The elements 52 and the hitch arms 60 are located at a suitable spacing to receive a portion of the stern of the kayak between the hitch arms 60.

The central shaft 108 includes a through passage extending centrally through the shaft in the longitudinal direction. The through passage 140 also extends through the ball and the stem of the ball for receiving a tether 142 slidably therethrough. The tether is anchored at the base of the stem of the ball at one end while extending forwardly to the operator seat of the kayak at the opposing end for selective anchoring as may be desired.

The tether 142 permits the container and the kayak to remain connected by an elongate flexible connection even when the ball is released from the socket as the tether is pulled slidably through the passage in the central shaft 108 as the ball is released from the socket and displaced rearwardly relative to the socket such that the end of the tether anchored to the base of the ball is displaced rearwardly with the ball relative to the socket.

When it is desirable to reconnect the container at a fixed spacing relative to the kayak, the operator pulls on the forward end of the tether to draw the tether slidably back through the longitudinal passage through the shaft so that the ball is guided into the socket. A generally conical guide flange 144 preferably tapers rearwardly and outwardly in all directions from the narrow mouth opening of the socket to slidably guide the ball to the central opening of the socket which faces rearwardly when reattaching the first and second ends of the connection member to one another.

A suitable actuator is provided in the form of an elongate cord 146 connected between the slide collar of the clamp 124 and a location adjacent the operator seat of the kayak so that an operator seated in the operator seat centrally on the kayak can pull on the cord and effectively pull the slide collar of the clamp slidably forward to release the socket into the released position thus allowing the two portions of the socket to separate sufficiently to receive the ball therein. Once the ball is received in the socket, the cord 146 can be released so that the spring biases the collar back into a closed or locked position so that the ball is effectively retained within the socket. The tether can then be released as no tension remains on the tether 142 once the socket is latched into the closed position. All towing force is carried by the ball and socket connection at a fixed towing distance between the container and the kayak.

If at any time a user seated in the operator seat of the kayak desires access to the container, the actuator can be used to release the ball from the socket so that the tether can be used to permit the container to drift rearwardly relative to the kayak with a sufficient length of the flexible tether being provided between the container and the kayak that the kayak can be brought into parallel configuration alongside the container. The operator can thus open the lid and access the interior of the container while remaining seated in the operator seat of the kayak. When it is desired to reconnect the container to the kayak using the ball and socket, the tether is simply pulled back through the through passage in the central shaft to draw the ball back into the socket at the rear end of the shaft where the clamp can be operated to open and close the socket to clamp the ball therein and return the container to a towed configuration at fixed spacing relative to the kayak.

The fixed length and rigid configuration of the connection member between the first end and the swivel and between the swivel and the second end ensures that there is no jerking motion when paddling with towed cargo as may occur with a flexible towing line in prior art configurations.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak such that the longitudinal direction is arranged to extend between the kayak and the cargo transport device;

the connection member comprising a swivel disposed between the first and second ends of the connection member;

the swivel being arranged to allow relative rolling motion between the first and second ends of the connection member about an axis extending in said longitudinal direction of the connection member such that the container is arranged to be rotatably connected to the kayak about the longitudinal axis the swivel comprising a ball secured to one of the ends of the connection member and a socket secured to the other one of the ends of the connection member in which the socket is arranged to receive the ball in mating connection therein;

the ball and the socket being oriented such that:

the first and second ends of the connection member are fully rotatable relative to one another for full rotations about said axis extending in the longitudinal direction; and the ball is pivotal relative to the socket away from the longitudinal axis in any direction.

2. The hitching device according to claim 1 in combination with a cargo transport device comprising a watertight towable container having a hollow interior arranged to receive cargo, at least one opening arranged for access to the interior, and a lid arranged to close said at least one opening in a transport position such that the hollow interior is arranged to be fully enclosed in the transport position.

3. The hitching device according to claim 2 in combination with a kayak wherein the container has a streamlined shape narrowing in a horizontal plane towards opposite ends of the container such that the cargo transport device and the kayak are substantially similar shape and the container is less than or equal to the kayak in width measured transverse to the longitudinal direction in a horizontal plane.

4. The hitching device according to claim 2 wherein said at least one opening comprises a plurality of openings in a top side of the container such that the openings span a majority of the top side of the container and wherein there is provided a lid arranged to selectively close each opening.

5. The hitching device according to claim 2 wherein said at least one opening comprises two openings in a top side of the container, each opening extending from an inner end adjacent a centre of the container to an outer end adjacent a respective end of the container, each opening including a lid arranged to selectively close the opening in which the lid is hinged on the container adjacent the outer end of the respective opening.

6. The hitching device according to claim 2 wherein the container is supported on a pair of wheels adjacent one end of the container for rolling movement along the ground, each of the wheels being received within a respective recessed wall portion in a bottom side of the container.

7. The hitching device according to claim 2 wherein the connection member is arranged for connection to the container adjacent a first end thereof and the hitching device further comprises a second connection member attached to the container adjacent a second end opposite the first end and arranged for connection to a second watertight towable container.

8. The hitching device according to claim 1 wherein the connection member is arranged to be fixed in length between the first end and the second end of the connection member.

9. The hitching device according to claim 1 wherein there is provided a pivot assembly at the first end of the connection member arranged for connection to the cargo transport device for relative pivotal movement about a first horizontal axis oriented transversely to the longitudinal direction and a pivot assembly at the second end of the connection member arranged for connection to the cargo transport device for relative pivotal movement about a second horizontal axis oriented transversely to the longitudinal direction.

10. The hitching device according to claim 1 wherein there is provided a fixed connecting portion arranged for fixed mounting on the kayak and a detachable connecting portion on the second end of the connection member arranged for selective detachment from and reattachment to the fixed connecting portion.

11. The hitching device according to claim 1 wherein the socket comprises first and second portions are arranged to be separable from one another along a plane extending in the longitudinal direction to release the ball therefrom and wherein there is provided a clamping member arranged to selectively secure the first and second portions to one another with the ball received therebetween such that the ball is arranged to be selectively retained in the socket.

12. The hitching device according to claim 11 wherein the clamping member comprises a collar which is slidable in the longitudinal direction between a clamping position in which the collar is clamped about the first and second portions to retain the ball in the socket and a released position in which the first and second portions are separable from one another to release the ball from the socket.

13. The hitching device according to claim 12 wherein the collar is biased towards the clamped position.

14. The hitching device according to claim 1 wherein there is provided a pair of hitch arms spaced apart from one another and extending generally in the longitudinal direction from the second end of the connection member so as to be arranged for connection at spaced apart positions on the kayak, the swivel being located between the hitch arms and the first end of the connection member for relative rolling movement of the hitch arms relative to the first end of the connection member about the longitudinal axis.

15. The hitching device according to claim 14 wherein the hitch arms are adjustable in length such that the swivel is arranged to be adjustable in the longitudinal direction relative to the kayak.

16. The hitching device according to claim 1 wherein the socket is arranged to be mounted in fixed relation to the kayak and the ball is arranged to be mounted in fixed relation to the cargo transport device, an open side of the socket being oriented to face rearwardly so as to be arranged to receive the ball therein.

17. The hitching device according to claim 16 wherein the ball is arranged to be readily releasable from the socket.

18. The hitching device according to claim 17 wherein the socket comprises an upper portion and a lower portion receiving the ball therebetween, the upper portion and the lower portion of the socket being readily separable from one another along a horizontal plane extending in the longitudinal direction so as to selectively release the ball therefrom.

19. A hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak;

the connection member comprising a swivel disposed between the first and second ends of the connection member;

the swivel being arranged to allow relative rolling motion between the first and second ends of the connection member about an axis extending in the longitudinal direction of the connection member such that the container is arranged to be rotatably connected to the kayak about the longitudinal axis; and the connection member is being arranged to be operable between a first mode in which the first and second ends of the connection member are coupled to one another at a fixed spacing in the longitudinal direction such that the kayak and the cargo transport device are arranged to be supported at a fixed spacing relative to one another and a second mode in which the first and second ends are coupled to one another by a flexible tether such that the kayak and the cargo transport device are arranged to be freely displaced relative to one another.

20. A hitching device for towing a cargo transport device behind a kayak, the hitching device comprising:

a connection member extending in a longitudinal direction between a first end and a second end;

the first end being arranged for connection to the cargo transport device;

the second end being arranged for connection to the kayak;

the connection member comprising a swivel disposed between the first and second ends of the connection member;

the swivel being arranged to allow relative rolling motion between the first and second ends of the connection member about an axis extending in the longitudinal direction of the connection member such that the container is arranged to be rotatably connected to the kayak about the longitudinal axis; and the connection member comprising a connector disposed between the first and second ends of the connection member, the connector being movable between a first position in which the first and second ends of the connection member are coupled to one another at a fixed spacing in the longitudinal direction such that the kayak and the cargo transport device are arranged to be supported at a substantially fixed spacing relative to one another and a second position in which the first and second ends are arranged to be freely displaced relative to one another; and the connection member further comprising an actuator arranged to control displacement of the connector between the first and second positions, the actuator being arranged for connection between the connector and an operator seat of the kayak such that the connector is arranged to be displaced between the first and second positions by an operator in the operator seat of the kayak.

* * * * *